United States Patent [19]

Raudonis et al.

[11] 4,091,642

[45] May 30, 1978

[54] CARRIAGE REVERSING CONTROL FOR A FLAT BED KNITTING MACHINE

[75] Inventors: John Anthony Raudonis, Union; Richard Mead, Whippany, both of N.J.

[73] Assignee: The Singer Company, New York, N.Y.

[21] Appl. No.: 788,857

[22] Filed: Apr. 19, 1977

[51] Int. Cl.[2] ..... D04B 7/10; D04B 15/36

[52] U.S. Cl. ..... 66/76; 66/128

[58] Field of Search ..... 66/76, 67, 70, 60 R, 66/60 H, 128, 157, 154 A

[56] References Cited

U.S. PATENT DOCUMENTS

| | | | |
|---|---|---|---|
| 3,035,426 | 5/1962 | MacQueen | 66/154 A X |
| 3,788,105 | 1/1974 | Brose | 66/157 |
| 4,006,611 | 2/1977 | Kahan et al. | 66/154 A X |
| 4,015,445 | 4/1977 | Kahan et al. | 66/154 A X |

FOREIGN PATENT DOCUMENTS

| | | | |
|---|---|---|---|
| 2,203,528 | 9/1972 | Germany | 66/154 A |
| 865,500 | 4/1961 | United Kingdom | 66/60 H |
| 1,017,996 | 1/1966 | United Kingdom | 66/70 |

*Primary Examiner*—Wm. Carter Reynolds
*Attorney, Agent, or Firm*—William V. Ebs; Edward L. Bell; Robert E. Smith

[57] ABSTRACT

A flat bed knitting machine having a motor driven carriage is provided with control means which counts needle slots as the carriage moves beyond working needles at one end or the other of the bed of the machine, and is effective when a predetermined count is attained to cause the motor to reverse the direction of movement of the carriage.

6 Claims, 5 Drawing Figures

CARRIAGE REVERSING CONTROL FOR A FLAT BED KNITTING MACHINE

BACKGROUND OF THE INVENTION

1. Field of the Invention

The invention relates to flat bed knitting machines having a motor driven carriage and in particular is directed to a novel motor control means for repetitively reversing the direction of movement of the carriage on the bed of the machine.

2. Description of the Prior Art

It is well known to provide motor controlling reed switches on flat bed knitting machines. Such switches are positioned on the bed prior to knitting and serve when actuated by the carriage to reverse the direction in which the carriage is driven by the motor. The points on the bed where carriage movement is reversed is established by the positions of the reed switches on the bed and is independent of the locations of the edges of the fabric knitted. As a garment is knit it is necessary to vary its width as by transferring stitches on needles of the machine. A garment is sometimes narrowed substantially in this manner and as a consequence the distance travelled by the carriage at such narrower widths as determined by the reed switches is considerably in excess of that required for properly knitting the garment. Knitting time is extended and the motor is operated for periods of times to no useful purpose.

SUMMARY OF THE INVENTION

The primary object of the invention is to control the operation of a drive motor for the carriage of a flat bed knitting machine according to the width of fabric being knit at any particular time. In accordance with the invention counting means are provided along with control circuitry for causing counts corresponding to needle positions to be accumulated when the carriage moves beyond working needles and causing the motor to reverse the direction of movement of the carriage when a predetermined number of counts have been accumulated. Such control circuitry prevents counts from being accumulated while the carriage moves through the working needles.

DESCRIPTION OF THE PREFERRED EMBODIMENT

Figure 1:
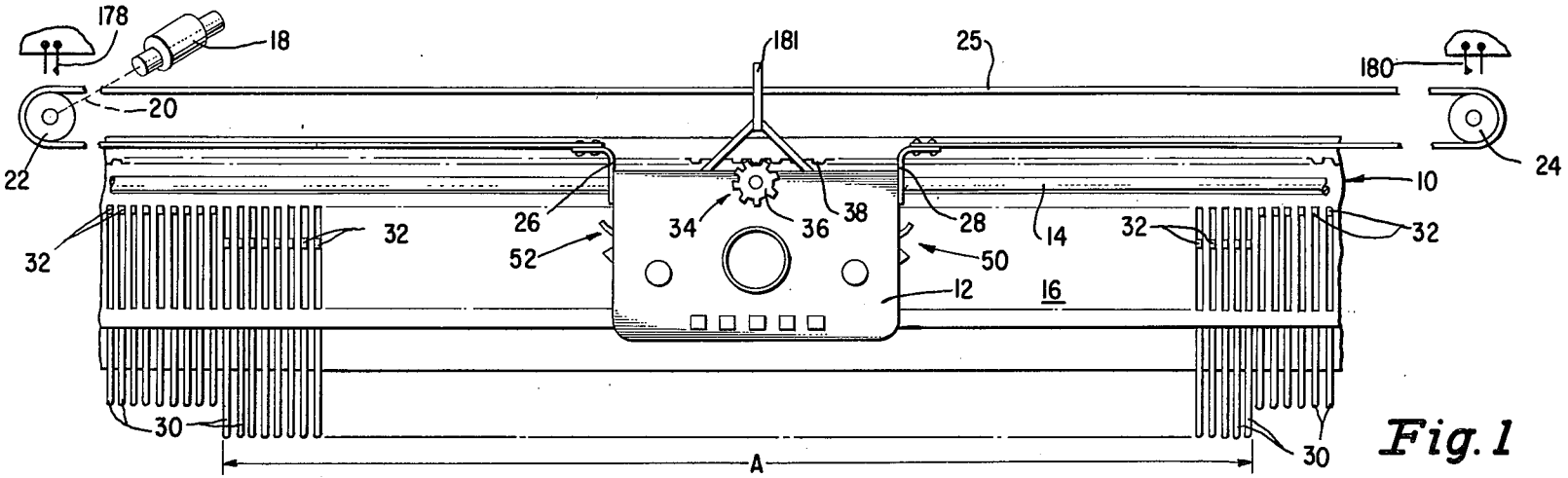
FIG. 1 is a schematic top plan view of a flat bed knitting machine including a motor driven carriage operated according to the invention.
Figure 2:
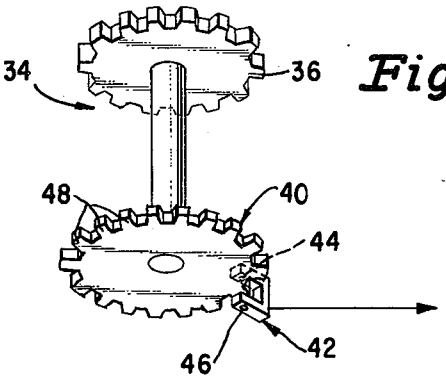
FIG. 2 is a perspective view of a pulse generator mounted on the carriage of the machine.
Figure 3:
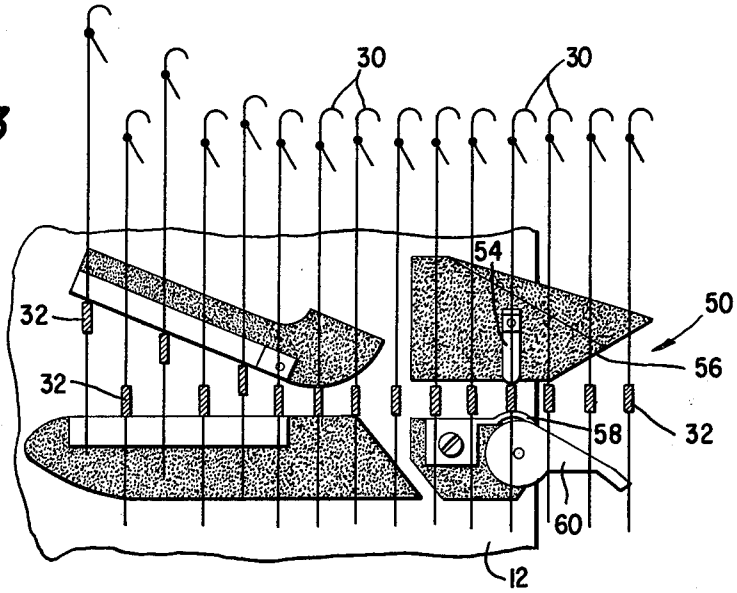
FIG. 3 is a bottom view showing one of a pair of needle butt detectors affixed to said carriage.

Referring to FIGS. 1, 2 and 3 of the drawings, reference character 10 designates the bed of a flat bed home type knitting machine including a carriage 12 which is slidable on rails 14 and 16 that are suitably secured to the bed. A motor 18 is provided to drive the carriage. Such motor connects through shafting, diagrammatically indicated at 20, with a drive pulley 22 located at one end of the bed of the machine. An idler 24 is located at the opposite end of the bed, and a belt 25 having opposite ends secured to brackets 26 and 28 on the carriage extends over the drive pulley 22 and idler 24. Needles 30 are slidable transversely in the bed and subject to actuation by camming on the underside of the carriage engageable with needle butts 32. Such camming may be of the type shown for example, in U.S. Pat. No. 3,991,592.

A pulse generator 34 rotatably mounted in the carriage 12 includes a pinion 36 which engages a gear rack 38 at the rear of bed 10 and drives a toothed disc 40. The disc 40 is associated with a photo-interrupter module 42 including a light emitting diode 44 on one side of the disc and a phototransistor 46 on the other side. Disc 40 is rotated in synchronism with carriage movement and equally spaced teeth 48 on the disc intermittently interrupt light between the light emitting diode 44 and phototransistor 46 causing the module 42 to provide output pulses. Module 42 is so located and the number of teeth 48 on disc 40 is such as to cause the module to produce a pulse each time the carriage passes from one needle position to the next.

Right and left needle butt detectors 50 and 52, respectively, are provided at opposite ends of the carriage on its under side. As shown, butt detector 50 includes a contact element 54 mounted in a fixed cam 56 and another contact element 58 in the form of a spring which in addition to serving as a contact functions as a biasing means for end cam 60. Needle butt detector 52 is constructed in the same manner as needle butt detector 50. The butts 32 of needles 30 which are in a selected working position (the needles extending across the distance A in FIG. 1) pass between cams 56 and 60 successively bridging the gap between contact elements 54 and 58 thereby closing an open circuit between them.

Figure 4:
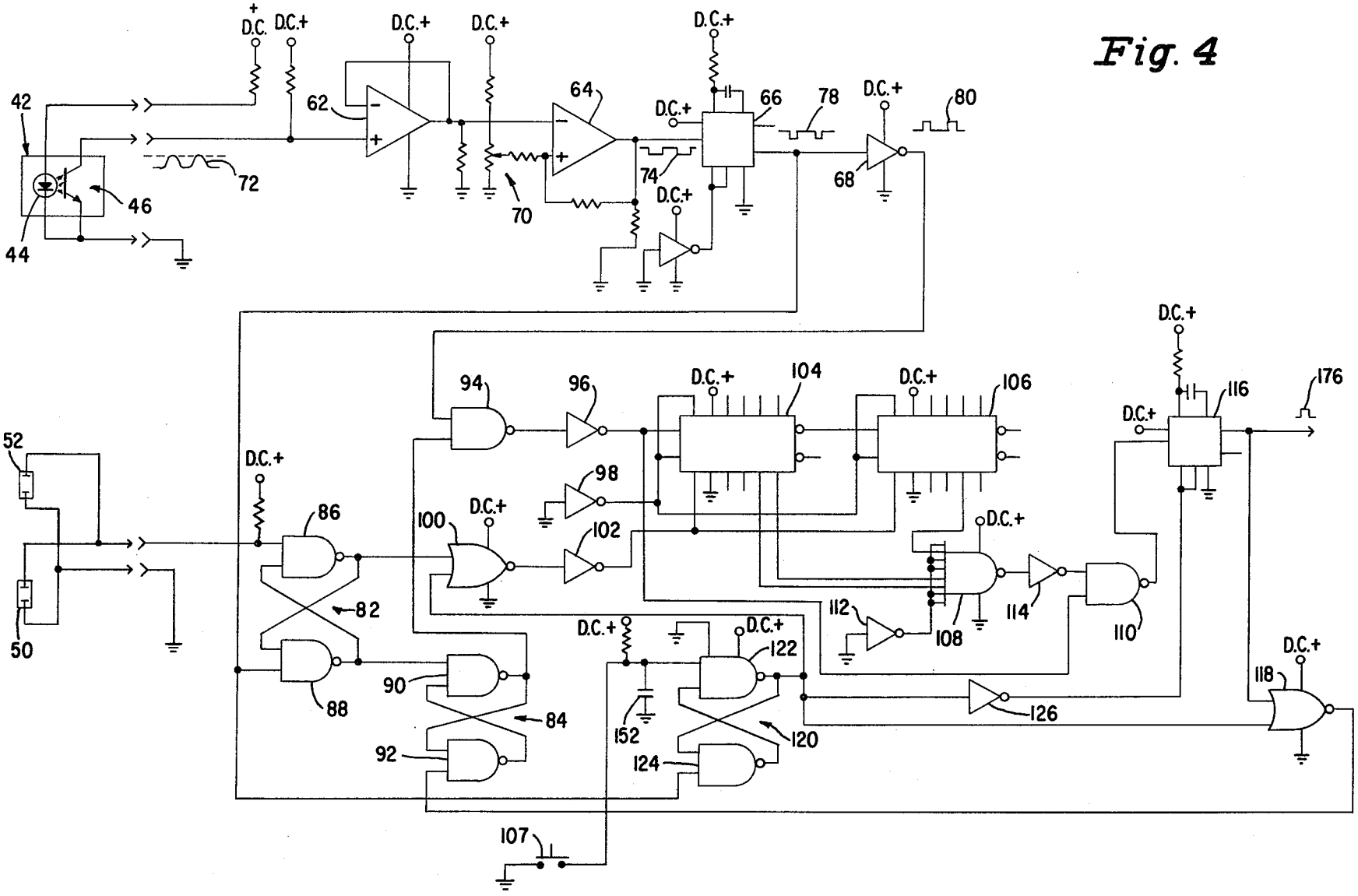
FIGS. 4 and 5 are diagrammatic illustrations showing the logic circuitry for controlling operation of the motor which drives the carriage.

The motor 18 is controlled by logic circuitry including pulse generator circuitry, butt detector circuitry, counter circuitry and resetting circuitry of FIG. 4. The major components of the pulse generator circuitry are the pulse generator module 42 including light emitting diode 44 and phototransistor 46, operational amplifiers 62 and 64, monostable multivibrator 66 and inverter 68. As may be seen in FIG. 4, the phototransistor 46 connects with operational amplifier 62. Such operational amplifier 62 is configured as a voltage follower and connects with the operational amplifier 64 which is configured as a voltage level detector. Amplifier 64 is provided with an input signal from amplifier 62, and also with a reference voltage from a potentiometer 70 which sets a detection level for amplifier 64. If the signal 72 resulting from operation of the pulse generator module 42 is less in amplitude than the detection level, the output of operational amplifier 64 is saturated at a high level, whereas if the signal is greater than the detection level, the amplifier output is saturated at a low level. Such output is a regenerated signal 74 with much faster rise and fall times than the pulse generator signal 72 into the voltage follower 62.

Regenerated signal 74 is fed to monostable multivibrator 66 which is triggered by the negative edge of each pulse of the regenerated signal, and caused to produce output pulses 78 of short duration (such as micro-seconds). The output of the multivibrator is fed to inverter 68 which converts the negative pulses of the multivibrator to positive pulses 80.

The butt detector circuitry includes butt detectors 50 and 52, and butt detector latches 82 and 84. Latch 82 includes NAND gate 86 which connects with the butt detectors, and NAND gate 88 which connects with multivibrator 66. Latch 84 is a first butt detector latch including NAND gates 90 and 92. NAND gate 90 receives input signals from NAND gate 88 of latch 82 and NAND gate 92 has a reversing signal, hereinafter described, as an input.

Counter circuitry within the motor controlling logic circuitry includes: a NAND gate 94 having the outputs of inverter 68 and NAND gate 90 as inputs; an inverter 96 having the output of NAND gate 94 as an input; a grounded inverter 98; a NOR gate 100 having the output of NAND gate 86 as one input and a reset signal as a second input; and an inverter 102 having the output of NOR gate 100 as an input. Such counter circuitry also includes: two cascaded four-bit binary counters 104 and 106 together constituting an eight-bit counter; NAND gates 108 and 110; and inverters 112 and 114. The outputs of inverters 96, 98 and 102 are inputs to the counters, and outputs of the counters as well as the output of inverter 112 are inputs to NAND gate 108. NAND gate 108, inverter 114, and NAND gate 110 are connected in series as shown. NAND gate 110 in addition to having an input from inverter 114 also receives an input from inverter 96.

The resetting circuitry includes: a monostable multivibrator 116 and NOR gate 118 which provide a reversing signal to NAND gate 92 of the first butt detector latch 84; an initial reset latch 120 comprising NAND gates 122 and 124; and an inverter 126 associated with the initial reset latch.

The motor control circuitry, includes, in addition to the elements already mentioned: an inverter 129 having the reversing signal output of multivibrator 116 as an input; a NAND gate 130 connected to the output end of the inverter; latches 132 and 134; NAND gate 136; and NAND gate 138 (See FIG. 5). As shown, latch 132 includes NAND gates 140 and 142, and latch 134 includes NAND gates 144 and 146. The output of NAND gate 130 is an input to each of NAND gates 140 and 142, and the outputs of NAND gates 136 and 138, are inputs to NAND gates 140 and 142 respectively. The outputs of NAND gates 140 and 142 are inputs to NAND gates 136 and 138 respectively and are inputs respectively to NAND gates 144 and 146. The output of NAND gate 140 is fed to NAND gate 142 and the output of NAND gate 142 is fed to NAND gate 140. Similarly, the output of NAND gate 144 is fed to NAND gate 146 and the output of NAND gate 146 is fed to NAND gate 144. The outputs of NAND gates 144 and 146 are also fed back to NAND gates 136 and 138 respectively. As shown the output ends of NAND gates 144 and 146 connect with relays 148 and 150 respectively, the operation of which determines the direction of rotation of motor 18.

Figure 5:
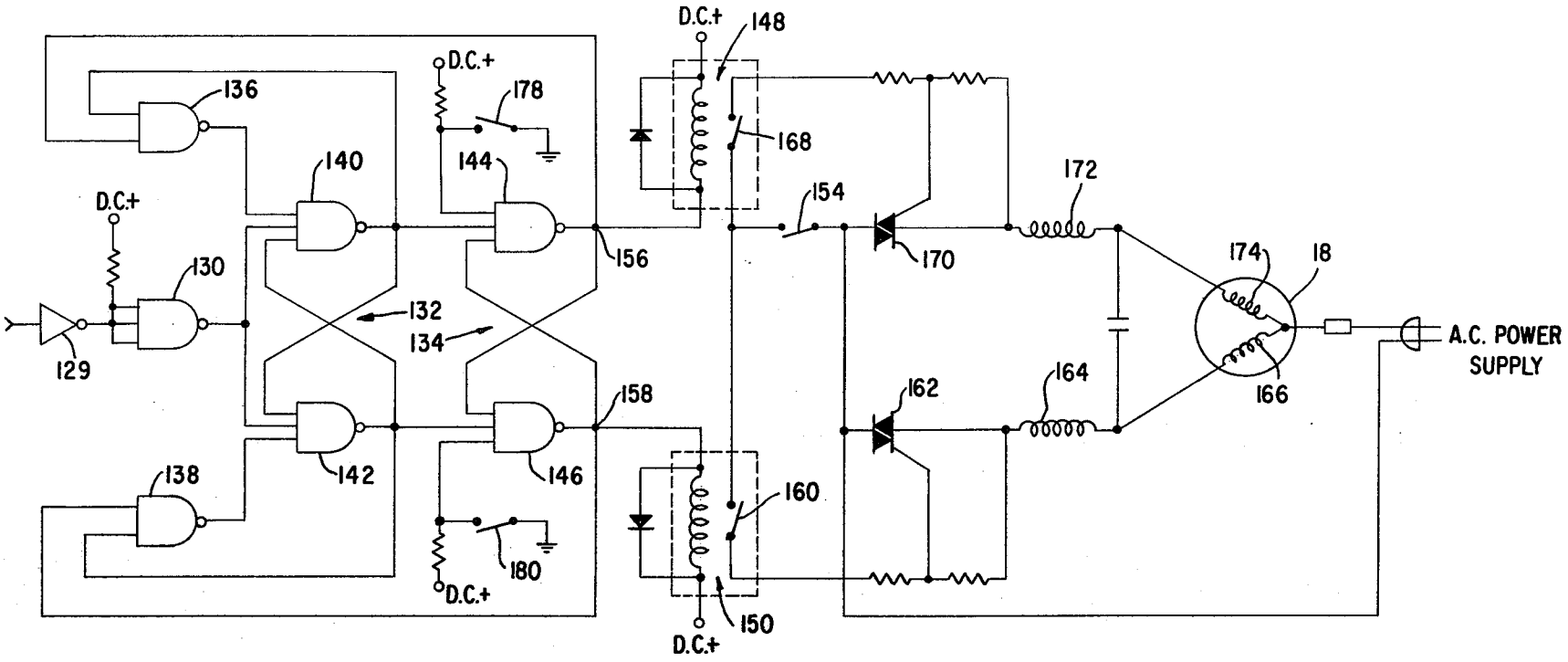

When DC voltage is first applied to the motor control system of FIGS. 4 and 5, a low initial input signal is fed to NAND gate 122 due to capacitor 152. The output of NAND gate 122 therefor goes high. Such output of NAND gate 122 is converted to a low signal in inverter 126 and applied to monostable multivibrator 116 to prevent the multivibrator from producing a reversing signal in response to the DC supply voltage applied to it. The high output signal from NAND gate 122 is also applied to NOR gate 118, and the NOR gate is thereby caused to produce a low input signal which becomes an input to NAND gate 92 and serves to clear the first butt detector latch 84. The high output of NAND gate 122 is also applied to NOR gate 100 which is therby caused to provide a low output that is inverted by inverter 102 and applied to counters 104 and 106 to set the counters to 0. A manual reset switch 107 can also be operated to reset the system at any time after it has been in operation.

After DC power has been applied to the motor control system an operator initiates operation of the motor by closing switch 154. The polarity at points 156 and 158 at such time may be positive and negative respectively or the reverse thereof. Assuming that when switch 154 is closed, the polarity at 156 is positive and is therefor negative at 158, relay 150 is energized to close contact 160 and complete a circuit over switch 154 and contact 160 which turns on triac 162 whereupon power is supplied to the motor 18 through windings 164 and 166 causing the motor to rotate in one direction. If the polarity at points 156 and 158 are negative and positive respectively when switch 154 is closed, relay 148 is operated to close contact 168 and turn on triac 170 whereupon power is applied to the motor over windings 172 and 174 causing the motor to rotate in the opposite direction.

If the carriage 12 of the knitting machine is over the working needles, within span A, when switch 154 is closed, the carriage is moved by motor 18 in the direction of one end or the other of the bed depending upon the polarity at 156 and 158. The pulse generator 34 is operated, multivibrator 66 produces negative output pulses 78 which are inputs to NAND gate 124, and the first such pulse clears initial reset latch 120, that is, causes the output of NAND gate 124 to become positive and the output of NAND gate 122 to become negative. Such negative pulses 78 are also inputs to NAND gate 88 and the initial pulse clears butt detector latch 82 by causing the output of NAND gate 88 to become positive and the output of NAND gate 86 to become negative. The positive output of NAND gate 88 causes the output of NAND gate 90 to go negative. Such negative output of NAND gate 90 then serves as an inhibit input to NAND gate 94 for positive pulses 80 from inverter 68 are also an input to NAND gate 94. The output of NAND gate 94 is a continuously positive signal which is inverted by inverter 96 to a negative signal and applied to counter 104. The counters however do not respond to negative signals and no counts are registered before one of the needle butts has been detected by a butt detector (right butt detector for rightward movement of carriage and left butt detector for movement of carriage to the left).

When a needle butt is detected by a leading butt detector, it provides a negative input signal to NAND gate 86 whereupon its output goes positive and the output of NAND gate 88 goes negative. The negative output of NAND gate 88 which is an input to NAND gate 90 causes the output of NAND gate 90 to go positive. Such positive output of NAND gate 90 which is an input to NAND gate 94 enables NAND gate 94 to provide negative output pulses, the inverter 96 to provide positive output pulses, and counters 104 and 106 to register counts in response to operation of the pulse generator. Each count registered by the counters is however erased for as long as needles move through the leading butt detector on the carriage of the machine. Detection of a needle butt after a count has been registered causes the output of NAND gate 86 to go positive and such positive output signal which is an input to NOR gate 100 causes the NOR gate to produce a negative output signal which is inverted by inverter 102 and supplied to counters 104 and 106 to reset the counters to 0. The counters accumulate counts only after the leading butt detector moves beyond the working needles and the butt detector signals cease.

As the leading butt detector moves beyond working needles, the counters accumulate counts up to a predetermined number corresponding to a position of the carriage wherein the following butt detector is just beyond the last working needle, and when the predetermined number of counts is attained, NAND gate 108 is caused by high outputs from the counters to produce a negative output pulse. Such negative output pulse is inverted by inverter 114 and applied to NAND gate 110 with the positive output pulses and inverter 96. NAND gate 110 produces a negative output pulse which is fed to monostable multivibrator 116 and such multivibrator produces a positive pulse 176 which, as explained hereinafter, serves to reverse the direction in which the carriage is driven by the motor on the bed of the machine. Such output pulse of the multivibrator 116 also serves as an input to NOR gate 118. The NOR gate 118 produces a negative output pulse that is fed to NAND gate 92 of the first butt detector latch and clears the latch.

After the direction of carriage motion is reversed and prior to detection of the first working needle by the new leading butt detector, inputs to the counters in response to the pulse generator signals are continuously negative for reasons already discussed and no counts are registered. Inputs to the counters become positive pulses after the first butt is detected and counts thereafter are alternately registered and erased as previously discussed until the leading butt detector moves beyond the last working needle. Beyond the last working needle counts accumulate and when the predetermined number of counts as hereinbefore mentioned are accumulated positive signal 176 is generated to once again reverse the direction of motion of the carriage. The carriage is reversed repeatedly as described after the trailing butt detector moves beyond the working needles, that is, until the operator opens switch 154.

The manner in which pulse 176 serves to reverse the direction of motion of the carriage by reversing the direction of motor 18 is rendered apparent in FIG. 5. Whatever the polarity of the outputs of NAND gates 144 and 146, that is, at points 156 and 158, (one polarity always being the opposite of the other) their polarities are reversed by a pulse 176 and the motor 18 is thereby caused to reverse its direction of rotation.

In the absence of a signal 176 the output of NAND gate 130 is negative and such negative output is an input to each of NAND gates 140 and 142. Assuming the polarities at 156 and 158 are positive and negative respectively, NAND gates 136 and 138 are provided with positive and negative feedback inputs respectively. The output of NAND gate 138 is therefor positive. The output of NAND gate 142 which is an input to each of NAND gates 138, 140 and 146 is also necessarily positive. The output of NAND gate 140 which is an input to NAND gates 136, 142 and 144 is rendered positive, and the output of NAND gate 136 which is an input to NAND gate 140 is rendered negative.

A positive pulse 176 is inverted in inverter 129 and fed to NAND gate 130 which is thereby caused to provide positive inputs to NAND gates 140 and 142. NAND gate 142 produces a negative output which becomes an input to NAND gates 138, 140 and 146. As a consequence of the negative input to NAND gate 146, this NAND gate produces a positive output reversing the polarity at 158 and such positive output is fed to NAND gates 138 and 144. The output of NAND gate 140 and inputs therefrom to NAND gates 136, 142 and 144 remain positive. All inputs to NAND gate 144 being positive, its output is caused to go negative thereby reversing the polarity at 156. The negative and positive polarities at 156 and 158 respectively, are fed back to NAND gates 136 and 138 causing the outputs of both NAND gates 136 and 138 to be positive. Such positive outputs are also inputs to NAND gates 140 and 142 and are effective to lock up latch 132. The reversed polarities at 156 and 158 which are also inputs to NAND gates 144 and 146 lock up latch 134. The circuitry of FIG. 5 is symmetrical and therefor with the polarity negative at 156 and positive at 158 such circuitry responds to a pulse 176 by causing these polarities to become positive and negative respectively.

Limit switches 178 and 180 are provided for preventing the carriage from being moved off the bed of the machine in the case where the carriage position is such, when switch 154 is closed by the operator, that at least one of the needle butt detectors is beyond the working needles and initial movement of the carriage is in a direction away from the working needles. The switches 178 and 180 are fixed spatially with respect to the bed and when actuated by a member 181 on the carriage serve to reverse the direction of rotation of motor 18 and therefor the direction of carriage motion by changing the polarity at points 156 and 158. Positive and negative polarities at 156 and 158 respectively correspond to leftward movement of the carriage and may result in the actuation of switch 178 which then serves to reverse the polarity at 158, and as a consequence of the change at 158, to also reverse the polarity at 156. Negative and positive polarities at 156 and 158 respectively correspond to rightward movement of the carriage and may result in the actuation of switch 180 which then effects a reversal in the polarity at 156 and because of the change at 156 also effects a reversal of the polarity at 158.

Numerous alterations of the structure herein disclosed will suggest themselves to those skilled in the art and it is to be understood that the present disclosure relates to an embodiment of the invention which is for purposes of illustration only. It is not to be construed as a limitation of the invention. All modifications which do not depart from the spirit of the invention are intended to be included within the scope of the appended claims.

Having thus described the nature of this invention, what is claimed herein is:

1. In a flat bed knitting machine including a carriage slidable on a needle bed and a reversible motor operably connected to the carriage for moving the carriage on the bed, the combination comprising pulse generating means operable to produce a pulse for each needle position as the carriage is moved on the bed, needle butt detecting means operable by needles in working positions as the carriage is moved on the bed, counting means operably connected with the pulse generating means and butt detecting means, said counting means being incremented by pulses from the pulse generating means and reset by pulses from the butt detecting means whereby the counting means is caused to accumulate counts only when the butt detecting means is moved by the carriage beyond the working needles, and means operably connected with the counting means and motor for reversing the direction of operation of the motor and thereby the direction of movement of the carriage on the needle bed when the counting means accumulates a predetermined number of counts, and means for setting the counting means to a zero count upon operation of the butt detecting means by the first needle detected as the butt detecting means is moved by the carriage into the working needles from a position beyond such needles.

2. The combination of claim 1 wherein the butt detecting means is a pair of butt detecting devices which are longitudinally spaced apart on the carriage, each butt detecting device of the pair being operable to detect needle butts only when leading in the direction of motion of the carriage.

3. The combination of claim 1 including limit switches operable in extreme positions of the carriage on the bed for reversing the direction of rotation of the motor.

4. The combination of claim 1 wherein the means for reversing direction of rotation of the motor includes circuitry for generating a pulse upon the accumulation of said predetermined number of counts, and other circuitry responsive to said pulse for altering current flow through the motor whereby its direction of rotation is reversed.

5. The combination of claim 4 wherein said other circuitry includes polarity reversing circuitry and relay means responsive thereto for controlling current flow through the motor.

6. The combination of claim 5 wherein said other circuitry includes means for locking in polarities controlling said relay means.

* * * * *